US007139507B2

(12) United States Patent
Sugimura et al.

(10) Patent No.: US 7,139,507 B2
(45) Date of Patent: Nov. 21, 2006

(54) IMAGE FORMING APPARATUS AND METHOD OF MOUNTING AND DEMOUNTING PROCESS CARTRIDGE

(75) Inventors: Naoto Sugimura, Saitama (JP); Koichi Yodose, Saitama (JP)

(73) Assignee: Fuji Xerox Co. Ltd., Tokyo (JP)

( * ) Notice: Subject to any disclaimer, the term of this patent is extended or adjusted under 35 U.S.C. 154(b) by 0 days.

(21) Appl. No.: 10/943,014

(22) Filed: Sep. 17, 2004

(65) Prior Publication Data

US 2005/0207783 A1 Sep. 22, 2005

(30) Foreign Application Priority Data

Mar. 22, 2004 (JP) ..... P.2004-082478
Mar. 22, 2004 (JP) ..... P.2004-082498

(51) Int. Cl.
*G03G 21/16* (2006.01)

(52) U.S. Cl. ..... 399/111; 399/107

(58) Field of Classification Search ..... 399/107, 399/111, 112, 113, 114
See application file for complete search history.

(56) References Cited

U.S. PATENT DOCUMENTS 5,867,751 A * 2/1999 Nomura et al. ..... 399/90
6,351,620 B1 * 2/2002 Miyabe et al. ..... 399/111
2002/0110385 A1 * 8/2002 Terada et al. ..... 399/111
2003/0059230 A1 * 3/2003 Yokoi et al. ..... 399/111

FOREIGN PATENT DOCUMENTS

| | | |
|---|---|---|
| JP | 2001-097590 A | 4/2001 |
| JP | 2001-130756 A | 5/2001 |
| JP | 2001-278188 A | 9/2002 |
| JP | 3363756 | 10/2002 |

* cited by examiner

*Primary Examiner*—David M. Gray
*Assistant Examiner*—Ryan D. Walsh
(74) *Attorney, Agent, or Firm*—Sughrue Mion, PLLC

(57) ABSTRACT

An image forming apparatus has an image forming apparatus body, a process cartridge which is provided in this image forming apparatus body so as to be mounted or demounted, a paper feeding tray adapted to be loaded with recording paper, and a small cover which is provided between the process cartridge in a mounted state and the paper feeding tray, and adapted to open or close an insertion inlet of the process cartridge, wherein a space for operating the paper feeding tray is converted into a space for mounting or demounting the process cartridge, by opening the small cover.

24 Claims, 5 Drawing Sheets

IMAGE FORMING APPARATUS AND METHOD OF MOUNTING AND DEMOUNTING PROCESS CARTRIDGE

BACKGROUND OF THE INVENTION

1. Field of the Invention

The present invention relates to an image forming apparatus in which an exchangeable unit such as a process cartridge is provided so as to be mounted or demounted.

2. Background Art

An image forming apparatus which has a mounting and demounting path for conducting mounting and demounting actions of a process cartridge provided above a paper feeding tray is disclosed in JP-A-2001-130756 and JP-A-2001-097590, for example. JP-A-2002-278188 also discloses an image forming apparatus which has a space between the process cartridge and the paper feeding tray.

Japanese Patent No. 3363756 also discloses an image forming apparatus which has a coupling member for actuating an opening/closing cover and a cartridge conveying member in association, whereby a cartridge can be conveyed in association with opening and closing actions of the opening/closing cover.

SUMMARY OF THE INVENTION

The invention has been made in view of the above described background, and to provide an image forming apparatus which is made compact, while ensuring operability of a tray.

Further, the invention has been made in view of the above described background, and to provide an image forming apparatus in which a process cartridge can be easily exchanged.

In order to attain the above described object, the image forming apparatus according to the invention includes an image forming apparatus body, a process cartridge which is provided in this image forming apparatus body so as to be mounted or demounted, a tray which is provided in the aforesaid image forming apparatus body and adapted to be loaded with recording medium, and an opening/closing cover which is provided between the process cartridge in a state mounted in the aforesaid image forming apparatus body and the aforesaid tray, and covers an opening of the image forming apparatus body so as to be opened or closed.

Preferably, the aforesaid tray is a paper feeding tray, the afore said paper feeding tray being arranged below the process cartridge which has been mounted on the image forming apparatus body, the aforesaid opening/closing cover being inclined, at least in a closed state, in such a manner that a lower end of this opening/closing cover may be located in a direction of inserting the recording medium of the aforesaid paper feeding tray than an upper end thereof.

Preferably, the aforesaid opening/closing cover is provided so as to be rotated with respect to the aforesaid image forming apparatus body, by means of a hinge provided at its lower end.

Preferably, the aforesaid process cartridge has an inclined face at a position opposed to the aforesaid tray, and the aforesaid opening/closing cover is provided substantially in parallel to the inclined face of the process cartridge, at least in the closed state.

Preferably, at least a part of a space between the aforesaid process cartridge in the mounted state and the aforesaid tray is converted, by opening and closing action of the aforesaid opening/closing cover, from a space for operating the tray into a space for operating the process cartridge or vice versa.

Preferably, the aforesaid opening/closing cover is provided so as to guide mounting and demounting actions of the aforesaid process cartridge, in an open state.

There is also provided, according to the invention, a method of mounting and demounting a process cartridge of an image forming apparatus which includes an image forming apparatus body, the process cartridge provided in this image forming apparatus body so as to be mounted or demounted, a paper feeding tray provided below this process cartridge, and an opening/closing cover provided between the aforesaid process cartridge in a mounted state and the aforesaid paper feeding tray, and covers an opening of the image forming apparatus body so as to be opened or closed, the method including steps of opening the aforesaid opening/closing cover, and inserting the aforesaid process cartridge into the aforesaid image forming apparatus body or with drawing it from the image forming apparatus body, while making the process cartridge slide along an upper face of the opening/closing cover which has been opened.

Further, in order to attain the above described object, there is provided, according to the invention, an image forming apparatus including an image forming apparatus body, a process cartridge which is provided so as to be mounted or demounted through an opening of this image forming apparatus body, and an opening/closing cover which covers the aforesaid opening of the image forming apparatus body so as to be opened or closed, wherein this opening/closing cover guides mounting and demounting actions of the process cartridge, in an open state thereof.

Preferably, the aforesaid opening/closing cover guides, in the open state, the aforesaid process cartridge to be mounted up to its mounting position, while making it slide.

Preferably, the aforesaid opening/closing cover has position restricting means for restricting the position of the aforesaid process cartridge in a lateral direction with respect to a direction of inserting the aforesaid process cartridge.

Preferably, the aforesaid opening/closing cover is further provided with conveying means which conveys the aforesaid process cartridge in a withdrawing or inserting direction, in association with opening or closing action of the aforesaid opening/closing cover.

Preferably, the aforesaid process cartridge has coloring agent, and the apparatus further includes a tray loaded with recording paper, below the process cartridge in amounted state, wherein the aforesaid opening/closing cover functions as a partition between the aforesaid process cartridge to be demounted and the aforesaid tray, at least in the open state.

According to the invention, there is also provided a method of mounting and demounting a process cartridge in an image forming apparatus which includes an image forming apparatus body, the process cartridge provided so as to be mounted or demounted through an opening of this image forming apparatus body, and an opening/closing cover which covers the opening of the image forming apparatus body so as to be opened or closed, the method including steps of opening the aforesaid opening/closing cover, and inserting the aforesaid process cartridge into the aforesaid image forming apparatus body or withdrawing it from the aforesaid image forming apparatus body, while making the aforesaid process cartridge slide along an upper face of the opening/closing cover which has been opened.

According to the image forming apparatus of the invention, it is possible to make the apparatus compact, while ensuring operability of the tray.

Further, according to the image forming apparatus of the invention, exchange of the process cartridge will be facilitated.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1:
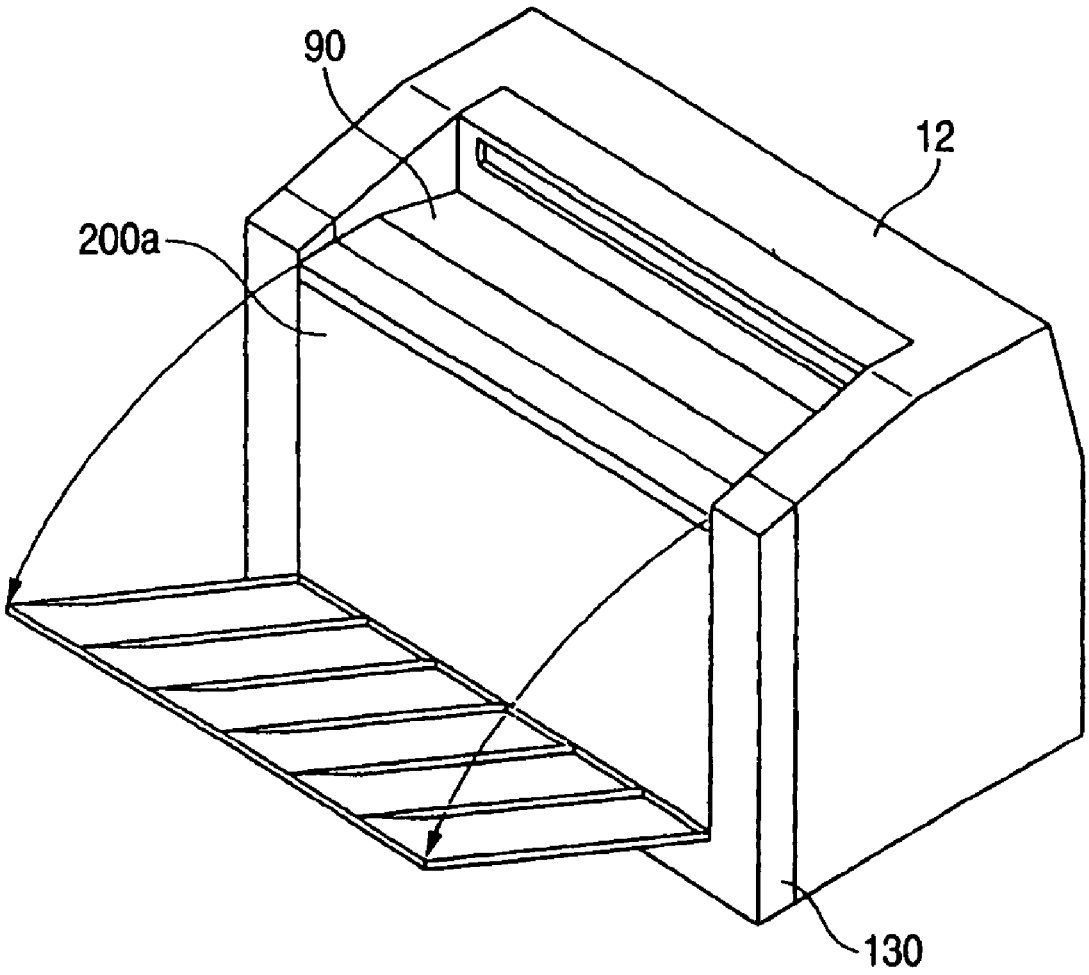
FIG. 1 is a view showing an outer appearance of an image forming apparatus 10 according to an embodiment of the invention.

A paper feeding tray for feeding recording paper or a paper discharging tray for discharging the recording paper requires a space (hereinafter referred to as an operating area) for operating the tray in an adjacent area, because it is necessary to conduct operation such as insertion or withdrawal of the recording paper. Particularly, because the tray is likely to be positioned below a visual point of a user, as the image forming apparatus becomes compact, and moreover, it is necessary to prevent the recording paper from falling from the tray, it is desirable that the operating area for the tray is secured above the tray. In case of the paper feeding tray for manually feeding the recording paper, because the recording paper is frequently exchanged and must be accurately conveyed one by one to the image forming apparatus, a considerable extent of accuracy is required in respect of loading position of the recording paper. For this reason, the paper feeding tray for manual feeding requires a space for visually confirming whether or not the recording paper has been correctly set, as well as a space for operation. Further, troubles may sometimes happen in actions of conveying the recording paper, and so, it is desirable that a wide operating area is secured near the paper feeding tray, in order to remove the recording paper jammed in an area upstream of a paper conveying path.

The image forming apparatus also requires an operating area for a process cartridge, in order to exchange the process cartridge which contains consumable articles such as toner.

However, after a toner cartridge, the process cartridge or the like has been installed in the image forming apparatus, the operating area for exchanging the process cartridge will be a dead space, having no particular purpose of use.

Under the circumstances, an image forming apparatus 10 in this embodiment is so constructed that the operating area for the tray and the operating area for the process cartridge may be co-used at least in a part thereof. More specifically, the image forming apparatus 10 is provided with a door which can be opened or closed for exchanging the process cartridge, between the tray and the process cartridge. In this manner, a space between the tray and the process cartridge will function as a part of the operating area for the process cartridge on occasion of exchanging the process cartridge, and on other occasions, the space will function as the operating area for the tray to be loaded with the recording paper. In other words, one space can be co-used for a plurality of purposes in this image forming apparatus 10, and down-sizing of the apparatus can be realized.

The process cartridge or the like is conveyed into the image forming apparatus through an opening formed in an image forming apparatus body. The opening has no particular function except on occasion of exchanging the process cartridge, and so, in many cases, there is provided a necessary minimum opening from a viewpoint of making the apparatus compact. Moreover, because the opening for exchanging the process cartridge is likely to be positioned below a visual point of a user, as the image forming apparatus becomes compact, and the process cartridge is usually mounted at a position deep inside the apparatus, the user is unable to visually confirm the mounting position of the process cartridge, unless he peeps through the narrow opening.

Further, it is undesirable, from the viewpoint of making the apparatus compact, to separately provide an exclusive conveying mechanism for the process cartridge.

Under the circumstances, an image forming apparatus 10 in this embodiment has a cover (a small cover 122 in the below described embodiment) which covers an opening for inserting the process cartridge so as to be opened or closed, and the process cartridge is guided by this cover to be introduced into the apparatus. More specifically, when the cover for mounting and demounting the process cartridge is opened, a user will find a guide mechanism for guiding the process cartridge to an interior of the apparatus, on an upper face of the cover. Accordingly, by opening the cover for mounting and demounting the process cartridge, and placing the process cartridge on the upper face of this cover to make it slide to a backward direction inside the apparatus, the user can easily convey the process cartridge to the mounting position inside the apparatus.

Now, the image forming apparatus 10 to which the invention is applied will be described referring to the drawings.

FIG. 1 shows an outer appearance of the image forming apparatus 10 according to the embodiment of the invention. The image forming apparatus 10 in this embodiment has an image forming apparatus body 12, and a paper feeding tray 20 in front of this image forming apparatus body 12. Moreover, the image forming apparatus 10 has a paper discharging tray 90 which is integrally formed with an upper face of the image forming apparatus body 12. The paper feeding tray 20 has a first tray plate 200*a* which can be rotated around a tray opening hinge 202 (described below) provided at its lower end. A large cover 130 covering a front face of the image forming apparatus body 12 is so constructed as to be rotated around a hinge provided at its lower end.

Figure 2:
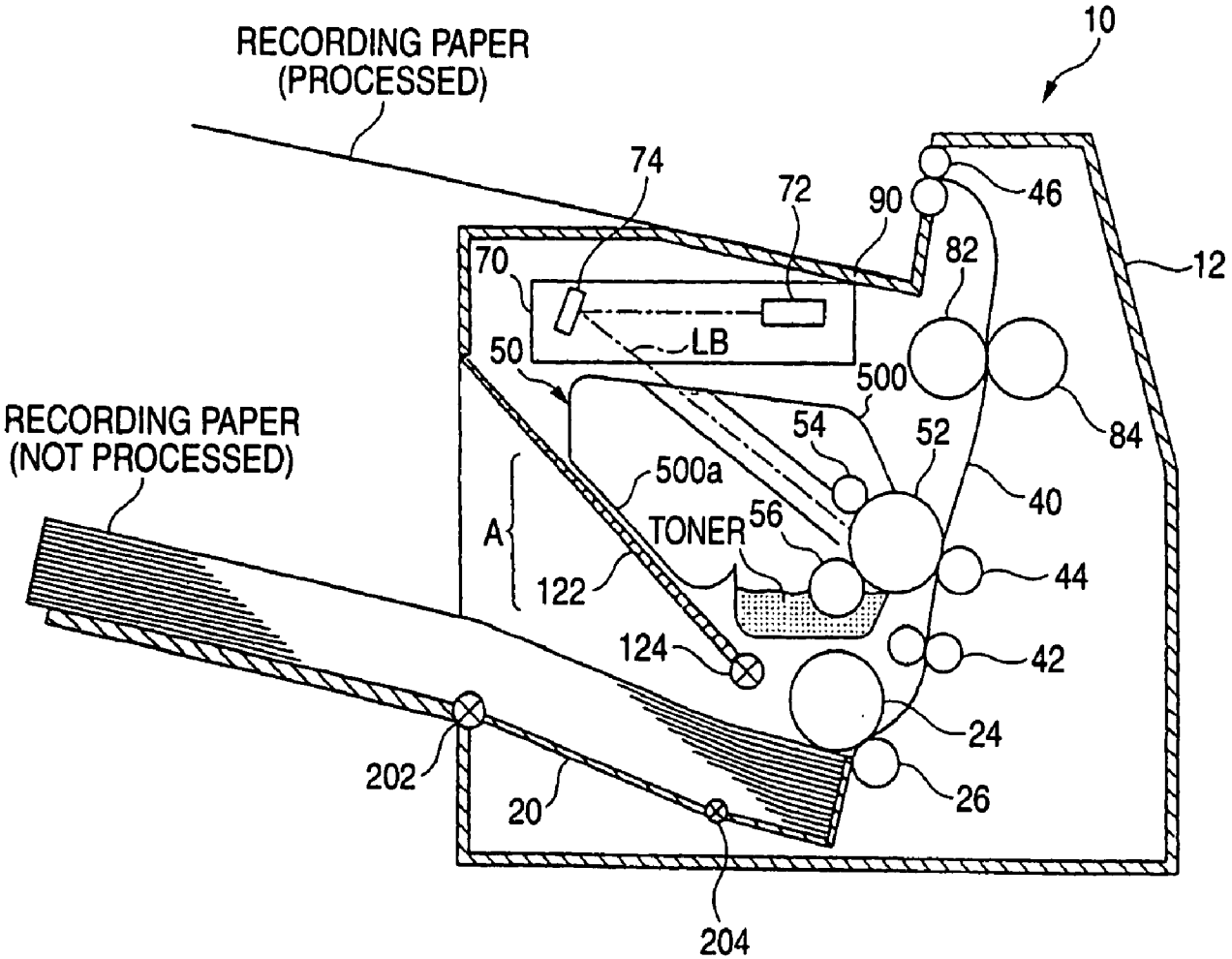
FIG. 2 is a sectional view showing a general structure of the image forming apparatus 10.

FIG. 2 is a sectional view of the image forming apparatus 10. The image forming apparatus 10 is provided with the paper feeding tray 20 for manual feeding, for example, in a lower part of the image forming apparatus body 12.

In describing respective components of the image forming apparatus 10 in this embodiment, it is to be noted that a left side face in FIG. 2 is called as "a front face", a right side face as "a back face", an upper side face as "an upper face", a lower side face as "a bottom face", a frontward face in the drawing as "a right side face", and a backward face in the drawing as "a left side face".

The paper feeding tray 20 is held by means of the tray opening hinge 202 which is fixed to the image forming apparatus body 12 and a tray adjusting hinge 204 which will be displaced according to a volume of the recording paper to be loaded. A feed roll 24 for feeding the recording paper from the paper feeding tray 20, and a retard roll 26 for dispensing sheets of the recording paper which have been fed one by one are arranged above the paper feeding tray 20 in an area close to a backward end thereof.

A paper conveying path 40 is a passage for the paper from the feed roll 24 to a pair of discharge rolls 46. This paper conveying path 40 is located adjacent to a back face (the right side face in FIG. 2) of the image forming apparatus body 12, and formed substantially vertically from the paper feeding tray 20 to a heating roll 82 and a pressurizing roll 84 which will be described below. In this paper conveying path 40, a transfer roll 44 which will be described below is arranged upstream of the heating roll 82 and the pressurizing roll 84, and a pair of registration rolls 42 are arranged upstream of the transfer roll 44.

Accordingly, the sheets of the recording paper fed out from the paper feeding tray 20 by means of the feed roll 24 are dispensed by the retard roll 26, and only the uppermost sheet is introduced to the paper conveying path 40 and temporarily stopped there by the registration rolls 42. After an appropriate timing, a toner image is transferred while the sheet passes between a photosensitive body 52 which will be described below and the transfer roll 44. The transferred toner image is fixed by the heating roll 82 and the pressurizing roll 84, and the sheet will be discharged from a discharge outlet by means of the discharge rolls 46 to the paper discharging tray 90 which is provided in an upper part of the image forming apparatus body 12. This paper discharging tray 90 is inclined in such a manner that its height is low in an area adjacent to the discharge outlet (near the discharge rolls 46) and becomes gradually higher in a forward direction (in the leftward direction in FIG. 2).

The image forming apparatus body 12 is provided with a process cartridge 50 so as to be mounted or demounted, in a substantially central part thereof, for example. The process cartridge 50 has a process cartridge body 500 which contains toner, the photosensitive body 52, an electrifying roll 54 for uniformly electrifying the photosensitive body 52, and a developing roll 56 for developing, with toner, an electrostatic latent image formed on the photosensitive body 52, all of which are integrally formed. The process cartridge 50 may further include, a cleaning blade (not shown) for scraping off residual toner which remains on the photosensitive body 52, and a toner recovering bottle (not shown) for recovering the toner which has been scraped off, upstream of the electrifying roll 54 in a rotation direction of the photosensitive body 52.

The process cartridge body 500 has an upper face and a bottom face which are substantially horizontal, and an inclined face 500*a* which is so inclined as to be gradually higher in a frontward direction (the leftward direction in FIG. 2). This inclined face 500*a* preferably has an angle of inclination which is larger than the paper feeding tray 20.

An exposing device 70 which writes the latent image on the electrified photosensitive body 52 by a laser beam (LB) is arranged above the process cartridge 50. The exposing device 70 has a laser beam emitter 72 for flashing the laser beam according to image data to be inputted, and a reflecting mirror 74 for guiding the laser beam irradiated from the laser beam emitter 72 in a direction to the photosensitive body 52.

In front of the process cartridge 50, there is arranged a small cover 122 (an opening/closing cover) which can be rotated around a small cover hinge 124 provided at its lower end. This small cover 122 is provided substantially in parallel to the inclined face 500*a* of the process cartridge body 500, in a closed state. Specifically, the small cover 122 is inclined in such a manner that its height is lower in an area adjacent to the small cover hinge 124 and becomes gradually higher in a frontward direction (the leftward direction in FIGS. 4 and 5A to 5C). An angle of inclination of the small cover 122 is larger than that of the paper feeding tray 20, and hence, there is formed, between the paper feeding tray 20 and the small cover 122, a space A which is gradually enlarged upwardly in the frontward direction. This space A is utilized as the operating area for the paper feeding tray 20, in a state where the small cover 122 is closed as shown in FIG. 2.

The transfer roll 44 and the photosensitive body 52 of the process cartridge 50 are opposed to each other at both sides of the paper conveying path 40. In other words, the toner image is transferred at a position between the transfer roll 44 and the photosensitive body 52, and at this transferring position, the transfer roll 44 transfers the toner image formed on the photosensitive body 52 onto the recording paper.

Fixing means including the heating roll 82 and the pressurizing roll 84 are arranged above the transferring position. The heating roll 82 and the pressurizing roll 84 fix the toner image which has been transferred onto the recording paper by the transfer roll 44, and convey the recording paper to the discharge rolls 46.

Then, image forming action of the image forming apparatus 10 will be described.

When an image forming signal is issued, the photosensitive body 52 is uniformly electrified by the electrifying roll 54, and a light beam is emitted from the exposing device 70 to this electrified photosensitive body 52, according to the image forming signal. The light beam from the exposing device 70 exposes a surface of the photosensitive body 52 to form a latent image thereon. The latent image on the photosensitive body 52 formed by the exposing device 70 is developed with black toner by means of the developing roll 56.

In the meantime, according to the paper feeding signal or the like, the sheets of the recording paper contained in the paper feeding tray 20 are fed out by the feed roll 24, dispensed by the retard roll 26 to be introduced to the paper conveying path 40, temporarily stopped by the registration rolls 42, and then, introduced between the photosensitive body 52 and the transfer roll 44 at an appropriate timing. When the recording paper has been introduced between the photosensitive body 52 and the transfer roll 44, the toner image formed on the surface of the photosensitive body 52 is transferred to the recording paper by means of the transfer roll 44. After the transfer, the residual toner which has remained on the photosensitive body 52 will be scraped off by the cleaning blade or the like, and recovered.

The recording paper on which the toner image has been transferred is introduced between the heating roll 82 and the pressurizing roll 84, and the toner image is fixed there by thermal pressure. The recording paper having the fixed toner image is discharged from the discharge outlet to the paper discharging tray 90 by means of the discharge rolls 46.

Then, a mechanism and actions for mounting and demounting the process cartridge 50 will be described.

Figure 3:
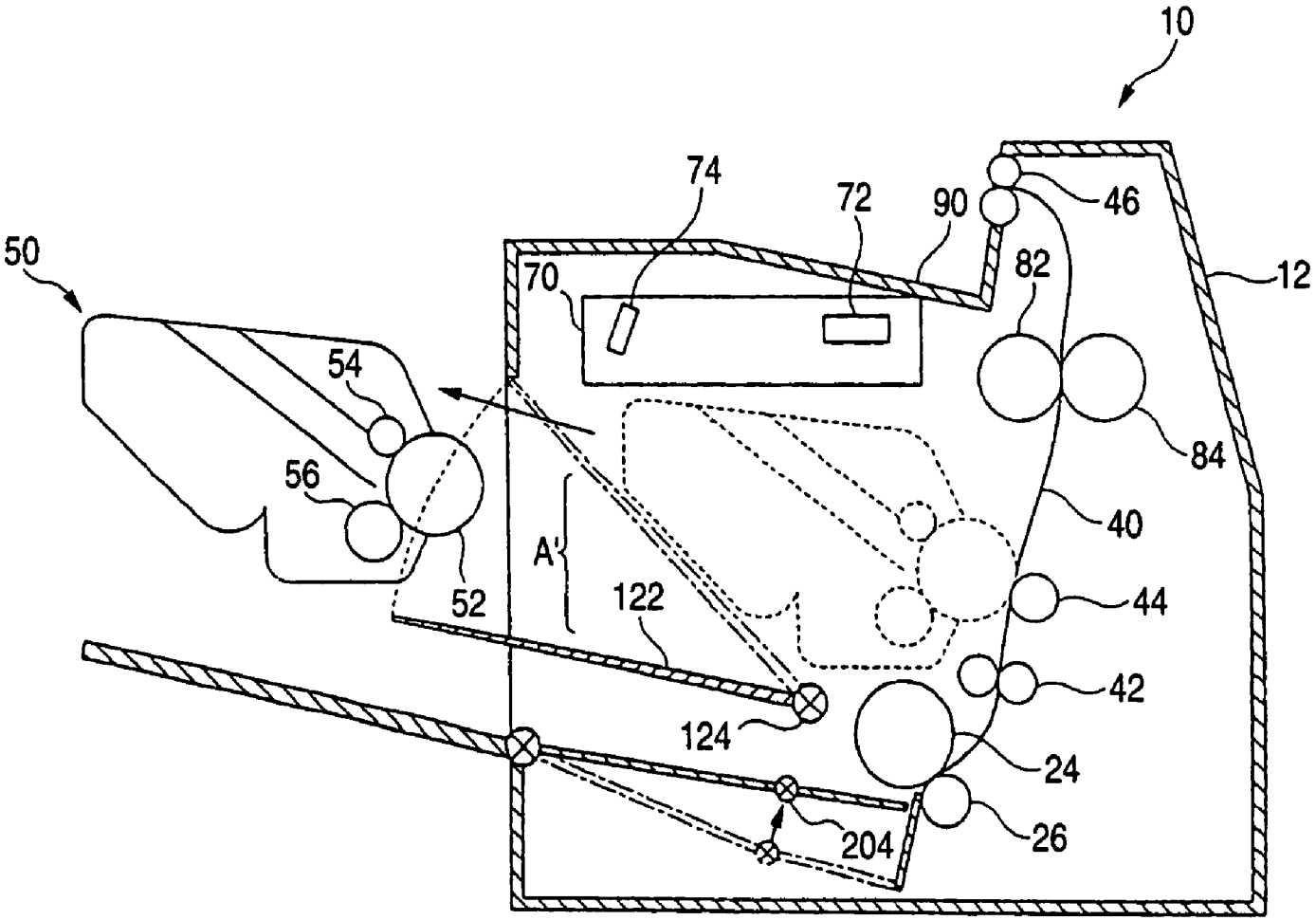
FIG. 3 is a view showing the image forming apparatus 10 on occasion of mounting or demounting a process cartridge 50.

FIG. 3 shows the image forming apparatus 10 on occasion of mounting and demounting the process cartridge 50. The small cover 122 is rotated forwardly around the small cover hinge 124 to open the front side (the leftward direction in FIG. 3) of the process cartridge 50. The space A (FIG. 2) between the paper feeding tray 20 and the process cartridge 50 is converted from the operating area for the paper feeding tray 20 into the operating area A' for the process cartridge 50, when the small cover 122 is opened. An upper face of the small cover 122 is so constructed that the process cartridge 50 can slide along the upper face, and the user can insert or withdraw the process cartridge 50 while making it slide on the small cover 122. By making the process cartridge 50 slide on the small cover 122 in this manner, a load for supporting the process cartridge 50 can be reduced, and at the same time, a vertical position of the process cartridge 50 will be restricted so as to be suitable for mounting the process cartridge, thus facilitating the mounting of the process cartridge 50. This is particularly advantageous in case where the mounting position of the process cartridge 50 is located deep inside the image forming apparatus body 12.

Figure 4:
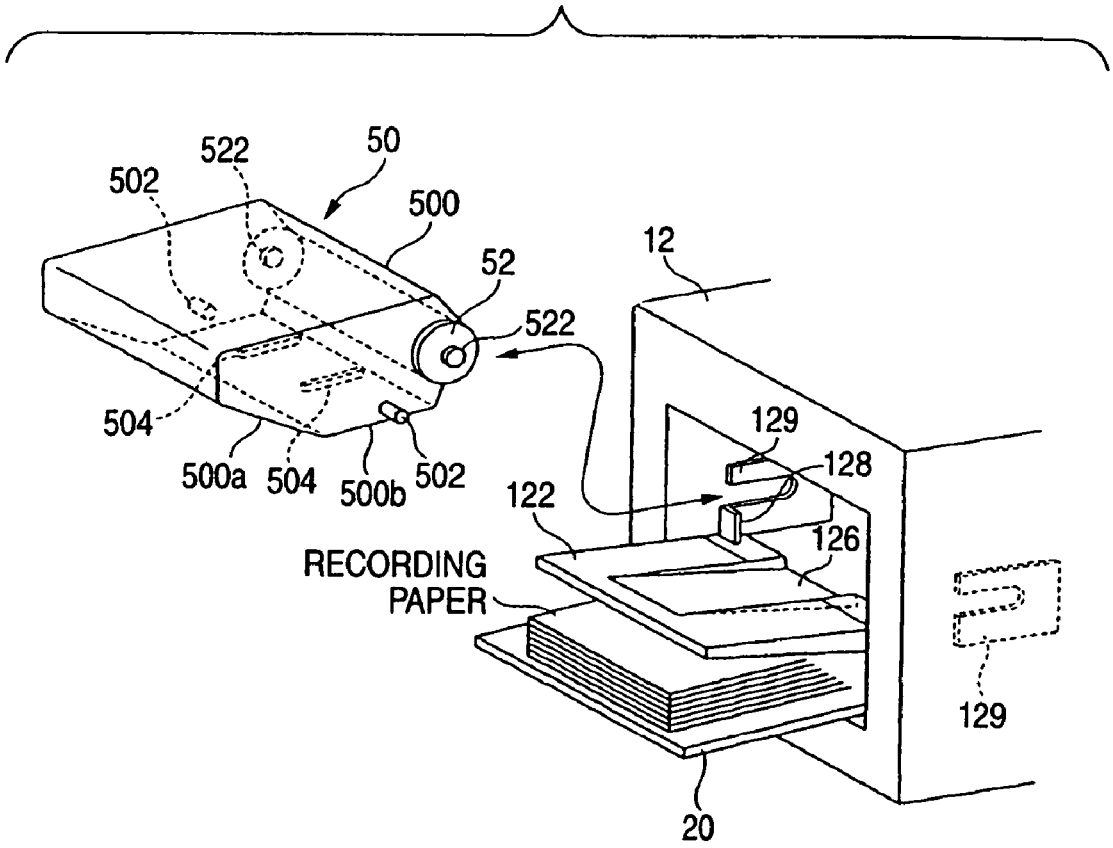
FIG. 4 is a view showing an outer appearance of the process cartridge 50 and an inserting position of the same.

FIG. 4 shows an outer appearance of the process cartridge 50 and an inserting position of the same. The process cartridge 50 has the photosensitive body 52 in a shape of a drum, near the back face (the right side face in FIG. 4) of the process cartridge body 500, and rotation shafts 522 are projected from both side faces of the photosensitive body 52. Moreover, the process cartridge body 500 is provided with pressed pieces 502 respectively projected from right and left side faces thereof. Further, bottom projections 504 are provided on a bottom face 500*b* of the process cartridge body 500.

The small cover 122 of the image forming apparatus 10 has cartridge pressing pieces 128 projected upwardly from the upper face thereof. These cartridge pressing pieces 128 are provided at such positions that they come into contact with the pressed pieces 502 of the process cartridge 50 to be inserted into the image forming apparatus body 12. The cartridge pressing pieces 128 are rotated in association with the small cover 122 and press the pressed pieces 502 in a frontward direction.

Further, the image forming apparatus body 12 is provided with side guides 129 respectively on right and left side inner faces thereof. The side guides 129 respectively have guide grooves for guiding the photosensitive body rotation shafts 522 of the process cartridge 50 to be inserted, and guide the process cartridge 50 up to the mounting position. For this purpose, the small cover 122 is so constructed that the photosensitive body rotation shafts 522 of the process cartridge 50 which has been placed on a deep end part of the small cover 122 may be substantially at the same height as the guide grooves of the side guides 129.

Still further, the upper face of the small cover 122 is provided with bottom guides 126 for restricting a lateral position of the process cartridge 50 to be mounted thereon. The bottom guides 126 in this embodiment are grooves which are dented corresponding to the bottom projections 504 of the process cartridge 50 to be mounted. By engaging the bottom projections 504 of the process cartridge 50 with these grooves, the lateral position of the process cartridge 50 can be determined. It is to be noted that the bottom guides 126 and the bottom projections 504 will not restrict the position of the process cartridge 50 in backward and forward directions, but the process cartridge 50 can be freely slid both in the forward and backward directions in a state placed on the small cover 122.

Figure 5A:
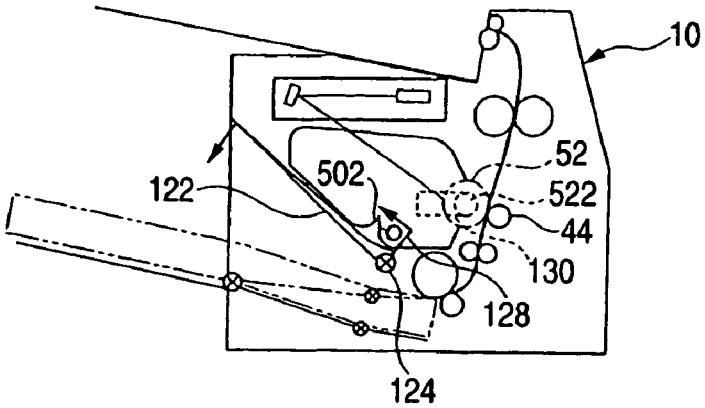
FIGS. 5A to 5C are views showing actions for withdrawing the process cartridge 50.
Figure 5B:
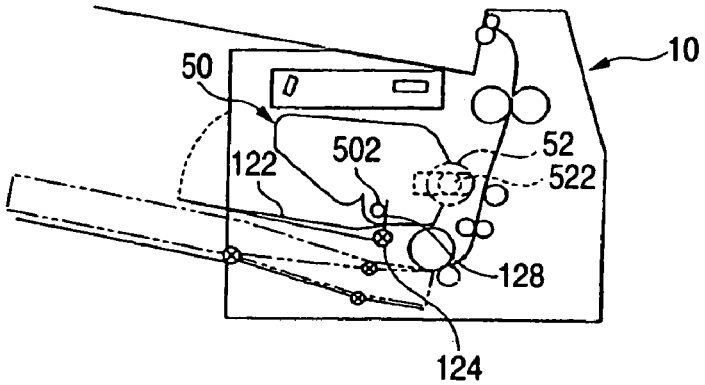
Figure 5C:
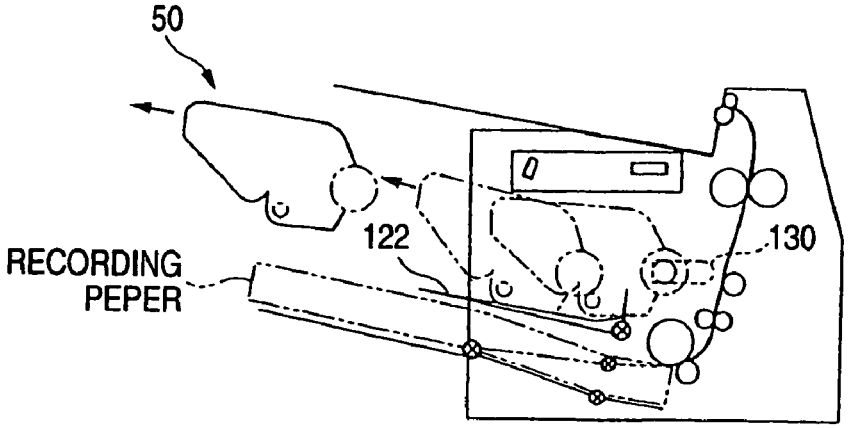

FIGS. 5A to 5C show withdrawing actions of the process cartridge 50. As shown in FIG. 5A, in a state where the small cover 122 is closed, the process cartridge 50 is fixed at the mounting position by securing means including a leaf spring or the like. In order to withdraw the process cartridge 50, the user rotates the small cover 122 as a first step. When the small cover 122 is rotated, the cartridge pressing pieces 128 provided on the small cover 122 are also rotated, and brought into contact with the pressed pieces 502 of the process cartridge 50 thereby to push them diagonally upwardly in the frontward direction.

The process cartridge 50 pushed diagonally upwardly in the frontward direction by way of the pressed pieces 502 will be released from the fixed state secured by the securing means, and displaced from the mounting position to the front side (the left side in FIGS. 5A to 5C), as shown in FIG. 5B. When the small cover 122 has been opened, the space between the paper feeding tray 20 and the process cartridge 50 in FIG. 5A (the operating area for the paper feeding tray 20) will be converted into the operating area for taking out the process cartridge 50.

When the user further withdraws the process cartridge 50 manually, the process cartridge 50 is slid along the upper face of the small cover 122 as shown in FIG. 5C, and taken out to the exterior of the image forming apparatus 10. On this occasion, the small cover 122 functions as a partition wall between the process cartridge 50 to be taken out and the paper feeding tray 20, and prevents adhesion of the toner falling from the process cartridge 50 during operation, to the recording paper placed on the paper feeding tray 20.

The mounting of the process cartridge 50 on the image forming apparatus body 12 will be conducted in a reverse order to the above described.

Specifically, as shown in FIG. 5C, the user opens the small cover 122, and puts the process cartridge 50 on the upper face of this small cover 122, making the bottom projections 504 (FIG. 4) of the process cartridge 50 engaged with the bottom guides 126 (FIG. 4) of the small cover 122. Then, the user pushes the process cartridge 50 into the depth (in a backward direction). The pushed process cartridge 50 is guided by the bottom guides 126 to slide along the upper face of the small cover 122, and conveyed up to such a position that the photosensitive body rotation shafts 522 (FIG. 4) of the process cartridge 50 may be guided by the side guides 129 (FIG. 4) of the image forming apparatus body 12. When the process cartridge 50 is further pushed in the backward direction to the depth inside the image forming apparatus body, the process cartridge 50 is guided by the side guides 129 and conveyed to the position where the pressed pieces 502 of the process cartridge 50 come into contact with the cartridge pressing pieces 128 of the small cover 122, as shown in FIG. 5B.

Thereafter, the small cover 122 is closed by the user, for example, and the inclined face 500*a* of the process cartridge 50 is pushed by the rotating small cover 122, so that the process cartridge 50 is conveyed up to a position where the photosensitive rotation shafts 522 come into contact with ends of the side guides 129, that is, the mounting position of the process cartridge 50.

As described herein above, according to the image forming apparatus 10, the space between the paper feeding tray 20 and the process cartridge 50 can be utilized as the operating area for the paper feeding tray 20 and as the operating area for the process cartridge 50, by converting the space through the opening or closing action of the small cover 122. This makes it unnecessary to provide a space for exchanging the process cartridge 50 separately, and it will be possible to make the image forming apparatus 10 compact.

Moreover, according to the image forming apparatus 10, by making this small cover 122 function as the guide member for the process cartridge 50, the mounting and demounting of the process cartridge 50 will be facilitated. This is advantageous, especially in case where the mounting position of the process cartridge 50 is located deep inside the image forming apparatus body 12. Specifically, in the image forming apparatus 10, the user is unable to visually confirm the mounting position of the process cartridge 50, unless he bends down to peep into the image forming apparatus 10. However, according to the invention, it is possible to mount the process cartridge 50 by simply pushing it in, without visually confirming the mounting position, because the process cartridge is guided by the small cover 122 at an earlier stage of the mounting action.

Further, because the small cover 122 functions as a partition wall between the process cartridge 50 to be demounted and the paper feeding tray 20, it is possible to prevent the recording paper placed on the paper feeding tray 20 from being soiled with the toner.

Further, the process cartridge 50 has been described, as an example of the exchangeable unit to be mounted or demounted by means of the small cover 122. However, the invention is not limited to such application to the process cartridge, but may be also applied to a toner cartridge which contains toner, for example.

Although the above described image forming apparatus 10 is a printer apparatus for conducting image formation employing monochrome toner, the apparatus may be a full color copying machine for conducting image formation employing four color toner including, C color, M color, Y color and K color, for example.

Further, although the paper feeding tray 20 for manual feeding has been described, the tray may be a paper feeding tray of a cassette type or a paper discharging tray.

Still further, projections (the bottom projections 504) are provided on the bottom face of the process cartridge 50, and grooves (the bottom guides 126) are formed on the upper face of the small cover 122. However, the invention is not limited to such structure, but it would be sufficient that the small cover 122 has position restricting means for restricting at least the lateral direction of the process cartridge 50. For example, concave-convex relation between the bottom face of the process cartridge 50 and the upper face of the small cover 122 may be reverse to the structure in the above described invention. Alternatively, the upper face of the small cover 122 may be provided with a groove which is adapted to be engaged with entirety of the bottom face 500*b* of the process cartridge 50, without providing the concaves or convexes on the bottom face 500*b*.

Further, according to the image forming apparatus 10, by making the small cover 122 function as the guide member for the process cartridge 50, the mounting and demounting of the process cartridge can be made easy. This is advantageous, especially in case where the mounting position of the process cartridge 50 is deep inside the image forming apparatus body 12. Specifically, in the image forming apparatus 10, the user is unable to visually confirm the mounting position of the process cartridge 50, unless he bends down to peep into the image forming apparatus body. However, according to the invention, it is possible to mount the process cartridge 50 by simply pushing it in, without visually confirming the mounting position, because the process cartridge is guided by the small cover 122 at an earlier stage of the mounting action.

Moreover, according to the image forming apparatus 10, it is possible to convey the process cartridge 50 in a mounting or demounting direction, in association with the rotating action of the small cover 122, because the small cover 122 is provided with the cartridge pressing pieces 128.

Further, in the image forming apparatus 10, the space between the paper feeding tray 20 and the process cartridge 50 can be utilized as the operating area for the paper feeding tray 20 and also as the operating area for the process cartridge 50, by converting the space through the opening and closing actions of the small cover 122. This will make it unnecessary to separately provide a space for exchanging the process cartridge 50, and it will be possible to make the image forming apparatus 10 compact.

What is claimed is:

1. An image forming apparatus comprising:

an image forming apparatus body;

a process cartridge removably mounted in the image forming apparatus body;

a tray provided in the image forming apparatus body and adapted to be loaded with recording medium; and a cover provided directly between the process cartridge and the tray;

wherein the cover is movable between a closed state in which the cover covers an opening of the image forming apparatus body and an open state in which the opening of the image forming apparatus is exposed.

2. An image forming apparatus according to claim 1, wherein:

the tray is a paper feeding tray;

the paper feeding tray is arranged below the process cartridge mounted in the image forming apparatus body; and at least in the closed state, the cover is inclined such that a lower end of the cover is located in a direction of inserting the recording medium of the paper feeding tray as compared to an upper end of the cover.

3. An image forming apparatus according to claim 2, wherein:

the cover is rotatably mounted to the image forming apparatus body by a hinge provided at the lower end of the cover.

4. An image forming apparatus according to claim 1, wherein:

the process cartridge has an inclined face at a position opposed to the tray; and the cover is provided substantially in parallel to the inclined face of the process cartridge, at least in the closed state.

5. An image forming apparatus according to claim 1, wherein:

at least a part of a space between the process cartridge and the tray is converted, by opening or closing the cover, from a space for operating the tray into a space for operating the process cartridge or from a space for operating the process cartridge into a space for operating the tray.

6. An image forming apparatus according to claim 1, wherein:

when the cover is in the open state, the cover guides mounting and demounting of the process cartridge.

7. An image forming apparatus according to claim 1, wherein the process cartridge is at least partially demounted when the cover is moved from the closed state to the opened state.

8. An image forming apparatus according to claim 7, wherein the process cartridge comprises process cartridge projections and the cover comprises cover projections which engage the process cartridge projections during moving the cover from a closed to an open state to at least partially demount the process cartridge.

9. The image forming apparatus of claim 1, wherein the cover is interposed between the process cartridge and the tray at least when the cover is in the closed state.

10. The image forming apparatus of claim 1, wherein the cover is interposed directly between the process cartridge and the tray.

11. A method of mounting and demounting a process cartridge in an image forming apparatus which includes an image forming apparatus body, a cover selectively covering an opening of the image forming apparatus body, and a recording medium feeding tray, the method comprising the steps of:

opening the cover to a first position so that the cover is directly between the recording medium feeding tray and a mounting space in the image forming apparatus body; sliding the process cartridge to the mounting space along a face of the opened cover; and closing the cover to a second position.

12. The method of claim 11, further comprising the steps of:

opening the cover and sliding the process cartridge out of the image forming apparatus body along the face of the opened cover.

13. The method of claim 11, wherein the face of the cover comprises a guiding portion and the step of sliding the process cartridge along the face of the cover comprises guiding the process cartridge along the guiding portion of the cover.

14. The method of claim 11, wherein, when the cover is in the second position, it is interposed between the recording medium feeding tray and the mounted process cartridge.

15. The method of claim 14, wherein, when the cover is in the first position, it is interposed directly between the recording medium feeding tray and the mounting space; and wherein, when the cover is in the second position, it is interposed directly between the recording medium feeding tray and the mounted process cartridge.

16. An image forming apparatus comprising:

an image forming apparatus body;

a process cartridge removably mounted in the image forming apparatus body;

an opening in the image forming apparatus body through which the process cartridge is mounted and demounted; and a cover moveable between a closed state in which the cover covers the opening of the image forming apparatus body and an open state in which the cover leaves the opening open;

wherein, when the cover is opened, at least a portion of a face of the cover is disposed in an internal space of the image forming apparatus body; and wherein the cover guides mounting and demounting actions of the process cartridge.

17. An image forming apparatus according to claim 16, wherein:

while in the open state, the cover guides the process cartridge to be mounted up to its mounting position, as the process cartridge slides along the cover.

18. An image forming apparatus according to claim 16, wherein:

the cover has position restricting means for restricting the position of the process cartridge in a lateral direction with respect to a direction of inserting the process cartridge.

19. An image forming apparatus according to claim 16, wherein:

the cover is further provided with conveying means which conveys the process cartridge in a withdrawing or inserting direction, in association with moving the cover between the open and closed states.

20. An image forming apparatus according to claim 16, wherein:

the process cartridge has a coloring agent;the apparatus further includes a tray loaded with recording paper as a recording medium, below the process cartridge; and at least when the cover is in the open state, the cover functions as a partition between the process cartridge and the tray.

21. An image forming apparatus according to claim 16, wherein the cover restricts the position of the process cartridge in a lateral direction with respect to a direction of inserting the process cartridge while it guides mounting and demounting the process cartridge.

22. An image forming apparatus according to claim 16, wherein the cover is disposed between the process cartridge and the tray.

23. An image forming apparatus according to claim 16, wherein:

the process cartridge has an inclined face at a position opposed to the tray; and at least when the cover is in the closed state, the cover is provided substantially in parallel to the inclined face of the process cartridge.

24. A method of mounting a process cartridge in an image forming apparatus which includes an image forming apparatus body, a cover selectively covering an opening of the image forming apparatus body and a recording medium feeding tray, the method comprising the steps of:

opening the cover;

inserting the process cartridge into the image forming apparatus body while making the process cartridge slide along an upper face of the opened cover; and closing the cover to a position between the process cartridge and the tray.

* * * * *